US006334507B1

(12) United States Patent
Westerweel

(10) Patent No.: US 6,334,507 B1
(45) Date of Patent: Jan. 1, 2002

(54) FALL PROTECTION SYSTEM AND TROLLEY FOR USE IN SUCH A SYSTEM

(75) Inventor: Jozef M. Westerweel, Bussum (NL)

(73) Assignee: Ziet Verder Beheer B.V., Laren (NL)

( * ) Notice: Subject to any disclaimer, the term of this patent is extended or adjusted under 35 U.S.C. 154(b) by 0 days.

(21) Appl. No.: 09/455,381

(22) Filed: Dec. 6, 1999

(30) Foreign Application Priority Data

Dec. 7, 1998 (NL) ..... 1010740

(51) Int. Cl.[7] ..... A62B 37/00
(52) U.S. Cl. ..... 182/36; 104/112
(58) Field of Search ..... 182/36, 3; 104/95, 104/107, 111, 112; 5/81.1 R, 85.1; 105/154

(56) References Cited

U.S. PATENT DOCUMENTS

| | | | | | |
|---|---|---|---|---|---|
| 276,815 | A | * | 5/1883 | Heidel | 182/36 |
| 293,451 | A | * | 2/1884 | Grosscup | 182/36 |
| 316,969 | A | * | 5/1885 | High | 182/36 |
| 375,089 | A | * | 12/1887 | Murchey | |
| 1,390,981 | A | * | 9/1921 | Butler | |
| 2,645,187 | A | * | 7/1953 | Guadagna | |
| 4,767,091 | A | * | 8/1988 | Cuny | 182/36 |
| 5,271,481 | A | * | 12/1993 | Rich | 182/36 |
| 5,297,651 | A | * | 3/1994 | Vandelinde | 182/36 |
| 5,711,397 | A | * | 1/1998 | Flora | 182/3 |
| 5,713,430 | A | * | 2/1998 | Cohen | 187/36 |

FOREIGN PATENT DOCUMENTS

| | | | | |
|---|---|---|---|---|
| CH | 70391 | * | 9/1915 | 182/36 |
| DE | 3722338 | | 1/1989 | |
| DE | 9200617 | | 3/1992 | |
| EP | 0273673 | | 7/1988 | |
| FR | 2681253 | | 3/1993 | |
| GB | 2293193 | | 3/1996 | |
| GB | 2322109 | | 8/1998 | |
| WO | 9826842 | | 6/1998 | |

* cited by examiner

*Primary Examiner*—Alvin Chin-Shue
(74) *Attorney, Agent, or Firm*—Oblon, Spivak, McClelland, Maier & Neustadt, P.C.

(57) ABSTRACT

A fall protection system includes substantially horizontal anchoring lines and at least one trolley capable of movement along the anchoring lines. The trolley moves with an object to be secured. The anchoring lines are arranged in parallel, spaced relation. the trolley is provided with multi-part running gear which makes contact with each of the anchoring lines. Such a fall protection system is low-noise and low-vibration, and enables easy passage of the trolley along anchoring line suports, withouyt requiring extra effort and without limiting the working space and the freedom of movement of the person secured to the fall protection system.

11 Claims, 1 Drawing Sheet

FALL PROTECTION SYSTEM AND TROLLEY FOR USE IN SUCH A SYSTEM

BACKGROUND OF THE INVENTION

1. Field of the Invention

Figure 2:
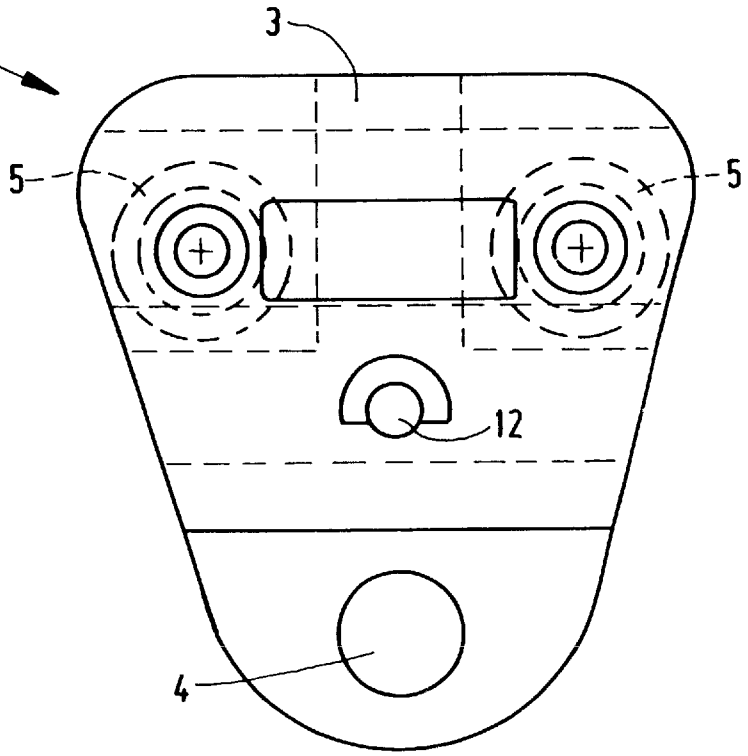

The present invention relates to a fall protection system comprising substantially horizontal anchoring lines and at least one trolley capable of movement along the anchoring lines, which moves with an object to be secured.

The present invention furthermore relates to a trolley for use in such a fall protection system.

2. Discussion of Background

Fall protection systems are used when working at great heights, for example on buildings, roofs, bridges and the like, and they function to provide adequate protection against falling.

EP-A-0 273 673 discloses a fall protection system. The fall protective system includes a trolley which is slidable along an anchoring line or cable. The trolley includes tubular coupling means being rotatable around the anchoring line. The coupling means is provided with a helical slot. An intermediate fixture or support holding the anchoring line engages the helical slot. The coupling means will rotate upon passing the support, whereby part of the kinetic energy of the trolley is converted into a rotary motion of the tubular coupling means. The coupling means then moves upwardly over a thickened portion provided around the anchoring line. The thickened portion engages the helical slot, thus holding the coupling means while passing the support. Then the coupling means, which continues to rotate, moves downwardly on the other side of the thickened portion and slides further along the anchoring line after having passed the support.

One drawback of the known anchoring line is the fact that a relatively large amount of kinetic energy is lost, at the expense of an unimpeded freedom of movement and work, upon passing the support of the anchoring line. The kinetic energy is lost both to rotating of the coupling means—in particular when dirt has settled on the anchoring lines, and to moving the trolley, first in an upward direction and then in a downward direction, along the support provided with the thickened portion.

SUMMARY OF THE INVENTION

The object of the present invention is to provide a safe, low-noise protection system which provides unimpeded freedom to work and an unobstructed maneuvering space.

In order to accomplish that objective, the fall protection system according to the present invention, is characterized in that the anchoring lines are arranged in parallel, spaced relation, and in that the trolley is provided with multi-part running gear which makes contact with each of the anchoring lines.

The advantage of the fall protection system, according to the present invention, is that the multi-part construction of the running gear of the trolley, which generally moves over two parallel anchoring lines, makes it possible to pass an anchoring line support running through the multi-part trolley without any obstruction, vibration or noise. The movement which the trolley makes upon passing the support is a movement in a direction exactly parallel to the anchoring lines, without any objectionable vibration or noise producing movement in transverse or vertical direction of the trolley, and without such passing requiring extra effort or attention from the person being protected by the fall protection system. Another advantage of the fall protection system, according to the present invention, is that the extent of protection and lasting reliability that is provided has been enhanced, since falling objects cannot damage the multi-part construction of the anchoring lines so easily any more—in particular near the supports—or cause them to kink. Moreover it has become apparent that a certain degree of sag in the case of heavier objects or loads, or in the case of larger free spans between adjacent supports of the anchoring lines, will less easily lead to an objectionable restriction of movement for the present multi-part system, since the multipart trolley distributes the forces better and moves more smoothly over the cables.

One embodiment of the fall protection system, according to the present invention, is characterized in that the running gear includes at least two rollers for the anchoring lines. The fact that the rolling of the running gear along the anchoring lines require comparatively little energy and can take place in a low-friction manner is also advantageous, since the running gear will be impeded much less by dirt which has settled on the anchoring lines.

Another embodiment of the fall protection system, according to the present invention, is characterized in that the multi-part running gear is of dual construction and is movable over a pair of anchoring lines. The advantage of this embodiment is the symmetric and simple construction of the trolley, wherein forces that occur will be distributed evenly over the two anchoring lines.

Another embodiment of the fall protection system, according to the present invention, is characterized in that the trolley is provided with a locking device, which prevents the anchoring line becoming detached from the trolley.

A very stable solution is provided by a fall protection system according to the present invention, which is characterized in that both the one part and the other part of the dual construction running gear comprises two rollers for the anchoring lines, one roller being arranged behind the other, which rollers run over the same anchoring line.

The advantage of this embodiment is that when the fall protection system becomes active in practice, the extent to which the anchoring lines may be weakened or damaged will be minimal, since the two-part running gear, each part comprising two rollers, will distribute the forces that will occur in case of a fall over the trolley and the anchoring lines, which anchoring lines cannot kink in that case.

Yet another embodiment of the fall protection system according to the present invention, is characterized in that the locking device extends through the transverse plane of the trolley, so that the locking and releasing of the locking device can take place in a simple manner, and so that it will also be easy to connect the trolley to and disconnect the trolley from the anchoring lines, Further advantageous embodiments of the fall protection system, according to the present invention, and of the trolley for use in the fall protection system, will be discussed in detail below.

BRIEF DESCRIPTION OF THE DRAWING FIGURES

Figure 1:
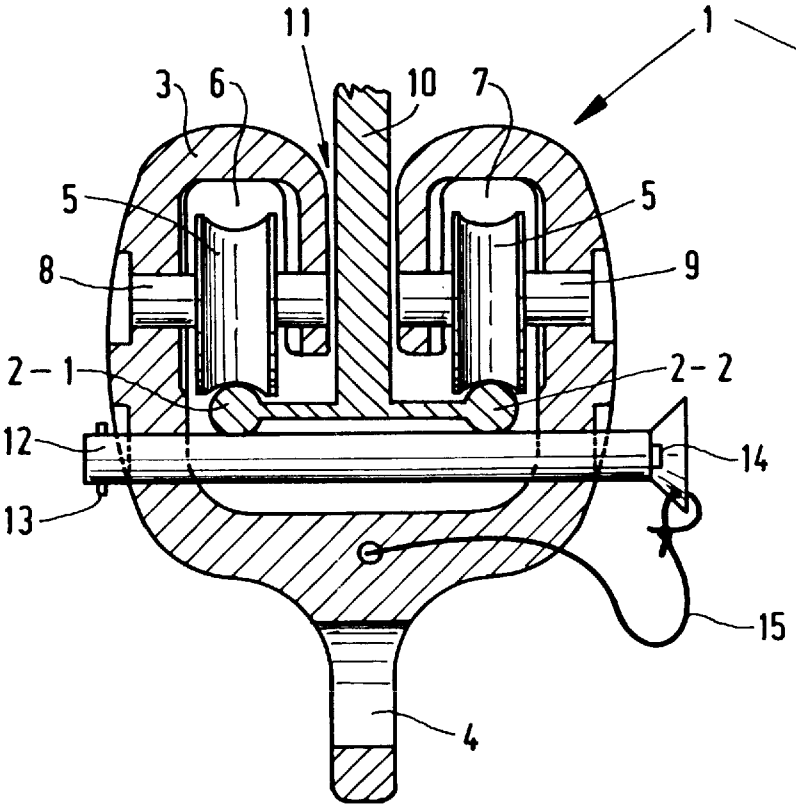

The present invention and its further advantages will now be discussed in more detail with reference to the accompanying drawing, wherein corresponding parts are indicated by the same numerals in the various Figures. In the drawing:

FIG. 1 shows a cross-sectional view of the fall protection system according to the present invention; and FIG. 2 shows a front view of a trolley for use in the fall protection system of FIG. 1.

DETAILED DESCRIPTION OF THE PREFERRED EMBODIMENTS

FIG. 1 is a partial cross-sectional view of a fall protection system 1 which is built up of anchoring lines, cables, bands or rails 2-1 and 2—2 arranged in side-by-side, parallel relation, over which a trolley 3 is movable in a longitudinal direction.

FIG. 2 is a right-hand side view of trolley 3. The anchoring lines 2-1 and 2—2 are generally provided horizontally above an object to be secured, for example, a person. The object (not shown) is coupled to an eye 4 present in the trolley 3 by coupling means, which are, for example, known from the field of industrial safety. The trolley 3 can move along anchoring lines 2-1 and 2—2 by means of running gear mounted in trolley 3, which is, in this embodiment, fitted with rollers 5 causing little friction with anchoring lines 2-1 and 2—2, in that rollers 5 roll over anchoring lines 2-1 and 2—2. In the illustrated embodiment, two rollers 5 are arranged one behind another in each of the cavities 6 and 7 of trolley 3. Rollers 5 are preferably made of a plastic, such as nylon, or other material, such as for example a metal (bronze), so that they can also be used in high-temperature environments, such as in ovens. Rollers 5 are rotatable about shafts 8 and 9 in cavities 6 and 7. Seen in the longitudinal direction, the anchoring lines 2-1 and 2—2 are interconnected in regularly spaced relation and secured to a structure (not shown) by means of intermediate fixtures or supports 10. FIG. 1 shows the situation in which trolley 3 just passes support 10. As FIG. 1 shows, the trolley 3 is of a symmetric construction, consisting of a left-hand and a right hand part, which parts are separated by an interspace 11, through which a vertical part of support 10 passes without impediment.

The trolley 3 is fitted with a locking device, which includes a locking pin 12, which extends exactly through the transverse plane between successive rollers 5 in the illustrated embodiment, as is shown in particular in FIG. 2. At the lefthand end, seen in FIG. 1, locking pin 12 is provided with a cross pawl 13 which is movable in a direction transverse to the longitudinal direction of locking pin 12, and which can be retracted into locking pin 12 when a spring-loaded release button 14, present on the right-hand end of locking pin 12, is depressed.

Only after release button 14 has been depressed can locking pin 12 be pulled out of trolley 3, by a double action, as it were, and trolley 3 can be simply detached from anchoring lines 2-1 and 2—2, if desired, by moving the separate anchoring lines 2-1 and 2—2 through the interspace. A safety wire or chain 15 connected to locking pin 12 and secured to trolley 3 ensures that locking pin 12 will remain near trolley 3 after being pulled out, so that the locking pin 12 can be inserted back in position again after some time, in which position the trolley 3 cannot be detached from anchoring lines 2-1 and 2—2. The locking pin 12, which can also be passed through trolley 3 at another location, if desired, is preferably made of hard steel, and trolley 3 is preferably made of light metal.

What is claimed as new and desired to be secured by Letters Patent of the United States is:

1. A fall protection system comprising:

substantially horizontal anchoring cables, wherein said anchoring cables are arranged in parallel, spaced relation to each other and each of said anchoring cables is approximately round in cross-section and has an approximately rounded outer contact surface;

at least one trolley for movement along said anchoring cables together with an object to be protected from falling by said fall protection system, said at least one trolley including a multi-part running gear having at least two rollers, wherein each roller of said at least two rollers has an approximately rounded concave outer surface for approximately matingly contacting said rounded outer contact surface of each of said anchoring lines, thereby reducing friction, and wherein said at least one trolley is approximately U-shaped in cross-section so as to have first and second arms extending from a base, said first and second arms being fixedly attached to said base at a predetermined distance from each other so that said first arm is non-movable with respect to said second arm; and a locking pin extending through said first and second arms below said at least two rollers to prevent said anchoring cables from becoming detached from said at least one trolley, said locking pin being a quick-release type locking pin having a spring-loaded release button;

wherein said running gear is of dual construction and is movable over a pair of said anchoring cables, said dual construction of said running gear including first and second parts each having two rollers for engaging one of said anchoring cables, a first roller of said two rollers being arranged behind a second roller of said two rollers, which first and second rollers run over a same anchoring cable of said anchoring cables.

2. The fall protection system according to claim 1, wherein a longitudinal axis of said locking pin is contained in a transverse plane of said at least one trolley, said transverse plane being perpendicular to a longitudinal axis of each of said anchoring cables.

3. The fall protection system according to claim 2, wherein said transverse plane extends between said first and second rollers, which first roller is arranged behind said second roller.

4. The fall protection system according to claim 1, wherein said spring loaded release button is located at a first end of said locking pin and a cross pawl is located at a second end of said locking pin so that said cross pawl is retracted when said release button is depressed in order for said locking pin to be removed from said at least one trolley.

5. The fall protection system of claim 4, further comprising a safety wire having first and second ends, said first end of said safety wire being connected to said first end of said locking pin and said second end of said safety wire being connected to said at least one trolley for preventing said locking pin from being separated too far from said at least one trolley when said locking pin is removed from a seated position within said at least one trolley.

6. The fall protection system of claim 4, wherein when said locking pin is removed from said at least one trolley, said anchoring cables can be removed from said at least one trolley through all interspace located between said at least two rollers.

7. The fall protection system of claim 4, wherein when said locking pin is seated in a position so as to be mostly within said at least one trolley, said locking pin contacts said anchoring cables.

8. The fall protection system of claim 1, wherein said anchoring cables are connected to each other by a T-shaped support at spaced locations along a length of said anchoring cables.

9. The fall protection system of claim 8, further comprising an interspace in which a leg of said T-shaped support extends through.

10. The fall protection system of claim 1, further comprising an eye extending through said at least one trolley, wherein said eye is for connecting the object to be protected from falling by said fall protection system to the trolley via a coupling means.

11. The fall protection system of claim 1, wherein said at least one trolley includes a right-hand part and a left-hand part which are mirror images of each other so that said at least one trolley is symmetrical.

* * * * *